US009477205B2

(12) United States Patent
Born et al.

(10) Patent No.: US 9,477,205 B2
(45) Date of Patent: Oct. 25, 2016

(54) TUNING FORK OSCILLATOR FOR TIMEPIECES

(71) Applicant: The Swatch Group Research and Development Ltd, Marin (CH)

(72) Inventors: Jean-Jacques Born, Morges (CH); Gianni Di Domenico, Neuchatel (CH); Baptiste Hinaux, Lausanne (CH); Jerome Favre, Neuchatel (CH); Dominique Lechot, Reconvilier (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/958,373

(22) Filed: Dec. 3, 2015

(65) Prior Publication Data

US 2016/0179058 A1 Jun. 23, 2016

(30) Foreign Application Priority Data

Dec. 18, 2014 (EP) ..... 14199040

(51) Int. Cl.
*G04B 17/04* (2006.01)
*G04C 3/10* (2006.01)
*G04C 3/00* (2006.01)

(52) U.S. Cl.
CPC ..... *G04C 3/101* (2013.01); *G04B 17/045* (2013.01); *G04C 3/008* (2013.01); *G04B 17/04* (2013.01)

(58) Field of Classification Search
CPC .... G04B 17/04; G04B 17/10; G04B 17/045; G04C 3/101
See application file for complete search history.

(56) References Cited

U.S. PATENT DOCUMENTS 3,170,278 A * 2/1965 Stutz ..... G04B 17/10 310/25
3,269,106 A * 8/1966 Waldburger ..... G04B 17/04 368/168

(Continued)

FOREIGN PATENT DOCUMENTS

EP 2 645 189 A1 10/2013
EP 2 706 416 A1 3/2014

OTHER PUBLICATIONS

European Search Report issued Sep. 23, 2015 in European application 14199040, filed on Dec. 18, 2014 ( with English Translation).

*Primary Examiner* — Sean Kayes
(74) *Attorney, Agent, or Firm* — Oblon, McClelland, Maier & Neustadt, L.L.P.

(57) ABSTRACT

A timepiece oscillator including a resonator formed by a tuning fork which includes at least two mobile oscillating parts, fixed to a connection element by flexible elements whose geometry determines a virtual pivot axis having a determined position with respect to this connection element and around which the respective mobile part oscillates, and the center of mass of the mobile part coincides in the rest position with the respective virtual pivot axis, and, for at least one of the two mobile parts the flexible elements are formed of intersecting resilient strips extending at a distance from each other in two parallel planes, and whose directions, in projection on one of the parallel planes, intersect at the virtual pivot axis of the mobile part.

18 Claims, 9 Drawing Sheets

(56) References Cited

U.S. PATENT DOCUMENTS 3,316,708 A * 5/1967 Waldburger ..... G04B 17/045 368/168
3,318,087 A * 5/1967 Favre ..... G04B 17/04 310/36
3,528,308 A * 9/1970 Favre ..... C10M 171/005 368/160
3,628,781 A 12/1971 Grib
8,987,979 B2 * 3/2015 Tamura ..... H03H 9/02157 310/344
9,075,394 B2 * 7/2015 Stranczl ..... G04B 15/00
9,134,705 B2 * 9/2015 Vardi ..... G04B 15/08
9,323,222 B2 * 4/2016 Stranczl ..... G04B 15/14
2015/0043313 A1 2/2015 Stranczl et al.
2015/0063082 A1 3/2015 Stranczl et al.
2015/0103636 A1 4/2015 Stranczl et al.
2015/0248112 A1 9/2015 Stranczl et al.

* cited by examiner

TUNING FORK OSCILLATOR FOR TIMEPIECES

This application claims priority from European Patent Application No 14199040.8 filed on Dec. 18, 2014; the entire disclosure of which is incorporated herein by reference.

FIELD OF THE INVENTION

The invention concerns a timepiece oscillator comprising a time base with at least one resonator formed by a tuning fork, which includes at least two mobile oscillating parts, said mobile parts being fixed to a connection element, comprised in said oscillator, by flexible elements whose geometry determines a virtual pivot axis having a determined position with respect to said connection element, said respective mobile part oscillates about said virtual pivot axis and the centre of mass of said mobile part coincides in the rest position with said respective virtual pivot axis.

The invention also concerns a timepiece movement including a structure to which one such oscillator is fixed.

The invention also concerns a timepiece or watch including at least one such movement.

BACKGROUND OF THE INVENTION

Timepiece time bases are always a compromise between good operating precision, acceptable efficiency, sufficient compactness and resistance for use in a watch, and economic production.

Sprung balance resonators are sensitive to external phenomena, the production and development thereof also requires highly qualified personnel, and it is difficult to achieve manufacturing reproducibility.

SUMMARY OF THE INVENTION

The invention proposes to make a high quality factor time base for mechanical timepiece movements, in order to ensure a high level of autonomy, and good operating precision, while satisfying quality standards, particularly in terms of behaviour with regard to shocks, temperature, and magnetism.

The invention also proposes to provide a simple and economic alternative to the sprung balance.

To this end, the invention concerns a timepiece oscillator comprising a time base with at least one resonator formed by a tuning fork, which includes at least two mobile oscillating parts, said mobile parts being secured to a connection element, comprised in said oscillator, by flexible elements whose geometry determines a virtual pivot axis having a determined position relative to said connection element, said respective mobile part oscillates about said virtual pivot axis, the centre of mass of the mobile part coincides in the rest position with said respective virtual pivot axis, characterized in that, for at least one said mobile part, said flexible elements are formed of intersecting resilient strips extending at a distance from each other in two parallel planes, and whose directions, in projection on one of said parallel planes, intersect at said virtual pivot axis of said mobile part concerned.

According to a feature of the invention, said resonator includes two said mobile parts whose centres of mass correspond to virtual pivot axes aligned with a main centre of said connection element.

According to a feature of the invention, said two mobile parts are symmetrical with respect to an axis of symmetry passing through a main centre of said connection element.

According to a feature of the invention, said connection element couples the motions of said two mobile parts by elastic forces.

According to a feature of the invention, said connection element is suspended by at least one resilient connection from a support arranged to be fixed on a structure of a timepiece movement.

According to a feature of the invention, said resilient connection is formed by resilient strips whose directions converge towards said main centre of said connection element.

According to a feature of the invention, at least one said mobile part includes a substantially circular arc about its said virtual pivot axis, said arc comprising an inertia block at each end thereof, and said flexible elements cooperating with said arc.

According to a feature of the invention, at least one said resonator is a one-piece assembly comprising said connection element, at least one said mobile oscillating part and said resilient strips which connect said mobile part to said connection element.

According to a feature of the invention, at least one said resonator is a one-piece assembly comprising said connection element, and a plurality of said mobile oscillating parts each including said resilient strips which connect the parts to said connection element.

According to a feature of the invention, said oscillator is one-piece assembly comprising said connection element and a plurality of said resonators.

According to a feature of the invention, said oscillator is one-piece assembly further comprising a support integral with the structure of a timepiece movement, and a resilient connection connecting said support to said connection element.

According to a feature of the invention, said one-piece assembly is made of silicon and/or a silicon oxide, or diamond-like-carbon (DLC), or quartz.

According to a feature of the invention, said resilient strips forming said flexible elements comprise an oxidation layer providing heat compensation.

According to a feature of the invention, said oscillator includes stop surfaces limiting the motion of each said mobile part.

The invention also concerns a timepiece movement comprising a structure to which one such oscillator is fixed, either directly by its connection element, or by a support to which said connection element is connected by a resilient connection.

The invention also concerns a timepiece or watch including at least one movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
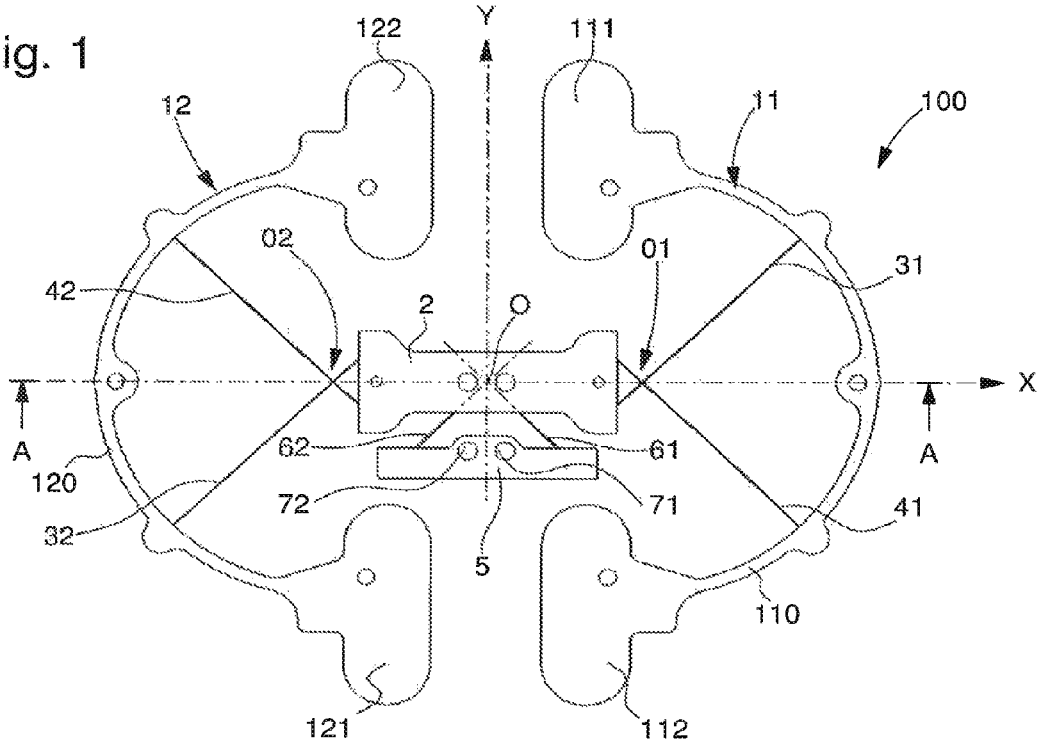
FIG. 1 shows a schematic plan view of an oscillator with a tuning fork resonator according to the invention, comprising two mobile parts arranged, in projection in a plane, symmetrically with respect to a connection element, to which each mobile part is connected by a resilient connection more specifically formed by flexible elements, and around which each mobile part oscillates about a virtual axis, said connection element being in turn connected by a resilient connection to a support integral with the structure of a timepiece movement; in this embodiment the flexible elements are resilient strips located on separate levels, and whose directions, in a neutral rest position of the resonator, intersect at the virtual axis concerned; the two virtual axes are aligned with a main centre on the connection element; the construction is entirely symmetrical with respect to a plane of abscissa containing the virtual axes and the main centre, and to an ordinate plane separating the two mobile parts and containing the main centre, and orthogonal to the plane of abscissa and intersecting it at the main centre.

The present invention refers to "centres of mass" which can also be understood to mean "centres of inertia".

The invention concerns a timepiece oscillator 200 including a time base with at least one resonator 100 formed by a tuning fork which comprises at least two mobile oscillating parts 11, 12.

These mobile parts 11, 12, are fixed to a connection element 2, comprised in oscillator 200, by flexible elements 31, 41 or respectively 32, 42, whose geometry determines a virtual pivot axis O1, O2, having a determined position with respect to connection element 2.

The mobile part 11, 12, whose centre of mass coincides in the rest position with said respective virtual pivot axis O1; O2, oscillates about the respective virtual pivot axis O1, O2.

According to the invention, for at least one of the two mobile parts 11, 12, flexible elements 31, 41, or 32, 42, are formed of intersecting resilient strips extending at a distance from each other in two parallel planes, and whose directions, in projection on one of the parallel planes, intersect at the virtual pivot axis O1, O2 of the mobile part 11, 12 concerned. These intersecting strips allow the weights to rotate, and substantially prevent translation of the weights in the three X, Y, Z directions and also provide good resistance to small shocks.

In a particular advantageous variant, illustrated by FIGS. 1, 2, 7, 9, 15, 16, 17, 18, at least one resonator 100 includes two such mobile parts 11, 12, whose centres of mass correspond to virtual pivot axes O1, O2, which are aligned with a main centre O of connection element 2.

The design of this resonator thus makes it possible to obtain a mean of the oscillations of each of the two mobile parts 11, 12: one oscillates more quickly if the other oscillates more slowly, the two centres of mass move, by a very small value, in the same direction X, but in different ways, which compensates for defects in the centres of mass.

The use of a tuning fork according to the invention can adjust the timing defect to a very low value, of a few seconds per day, since moving the centres of mass perpendicularly to the connection direction X does not affect chronometry.

The case of an symmetrical tuning fork is merely a particular case, and the invention also functions with an asymmetrical tuning fork.

The resulting movement relative to the plate of a movement on which such an oscillator 200 is fixed, is virtually zero. No loss on the support guarantees a high quality factor, much higher than that of a sprung balance.

In a particular embodiment, as seen in FIGS. 1, 2, 7, 15, 16, 17, 19, the two mobile parts 11, 12, are symmetrical, in projection on a plane parallel to that of the intersecting resilient strips, with respect to an axis of symmetry passing through a main centre O of connection element 2.

More specifically, these two mobile parts 11, 12 are symmetrical with respect to main centre O.

Even more specifically, these two mobile parts 11, 12, are identical.

In an advantageous manner specific to the invention, connection element 2 couples the motions of the two mobile parts 11, 12, by elastic forces. Element 2 is arranged to couple the two mobile parts 11, 12, to ensure a symmetrical motion of said parts with respect to main centre O, preferably by means of a symmetrical arrangement of the attachments of flexible elements 31, 41, 32, 42, to said connection element 2.

In an advantageous embodiment, and as seen in a non-limiting manner in FIGS. 1, 2, 5, 6, 11 to 14, connection element 2 is suspended by at least one resilient connection 60 to a support 5 arranged to be fixed on a structure of a timepiece movement 300, through securing holes 71, 72. Preferably, this connection 60 has several degrees of freedom, either in a plane XY parallel to that of the intersecting strips, or freedom to pivot in said plane.

In a variant, as seen in FIGS. 1, 2, 6, 11, 12, this resilient connection 60 is formed by resilient strips 61, 62 whose directions converge towards the main centre O of connection element 2.

Figure 5:
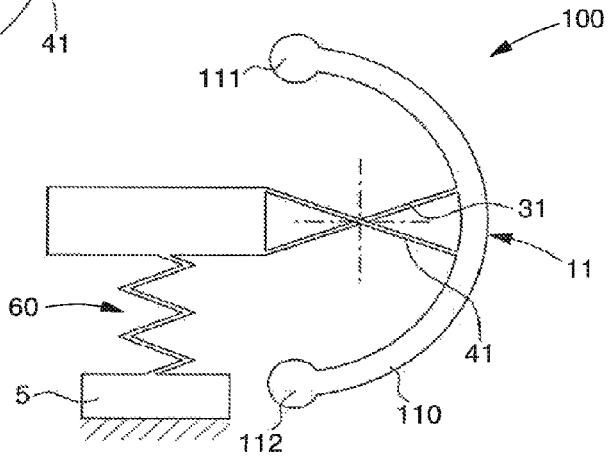
FIG. 5 shows a partial view of the resonator of FIG. 4, wherein the connection element is connected to a fixed support integral with the structure by a single resilient connection.
Figure 13:
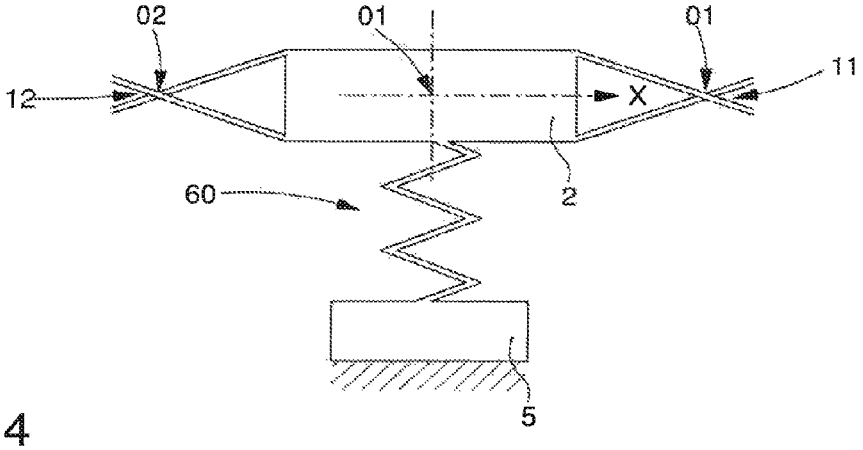
Figure 14:
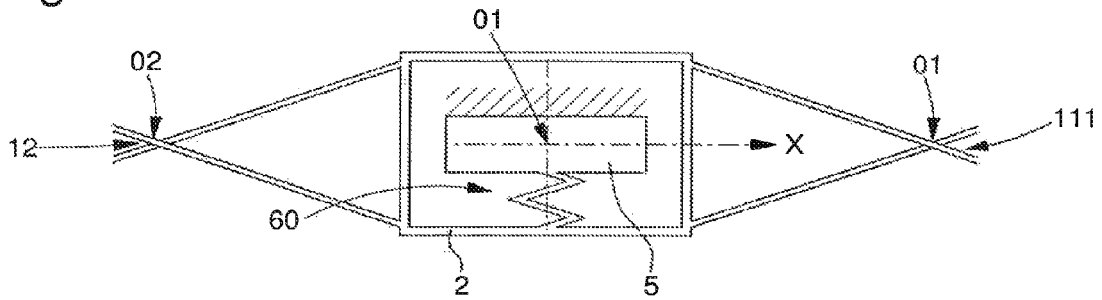

In another variant, as seen in FIGS. 5, 13, 14, resilient connection 60 is achieved by means of a single strip, or a spring, or suchlike, arranged to be fixed to such a support 5.

In an advantageous embodiment of the invention, as seen in FIGS. 1, 2, 4 to 10, 15 to 18, 21, at least one such mobile part 11; 12 includes a substantially circular arc 110; 120 about its respective virtual pivot axis O1; O2. This arc 110; 120, includes an inertia block 111, 112, respectively 121, 122, at each end thereof. Flexible elements 31, 41, respectively 32, 42, cooperate with the arc 110; 120 concerned.

It is understood that excitation of the resonator can be achieved either on an arc, or an inertia block, this latter alternative being the most convenient to achieve.

In a particular non-limiting embodiment, the resilient strips which form flexible elements 31, 41, 32, 42, are less stiff than the respective arc 110; 120, which is in turn less stiff than the respective inertia blocks 111, 112, 121, 122. The latter are preferably infinitely stiff. In another variant, arcs 110, 120 and inertia blocks 111, 112, 121, 122, are of equal stiffness, and only resilient strips 31, 41, 32, 42, are less stiff than the arcs and inertia blocks.

Figure 19:
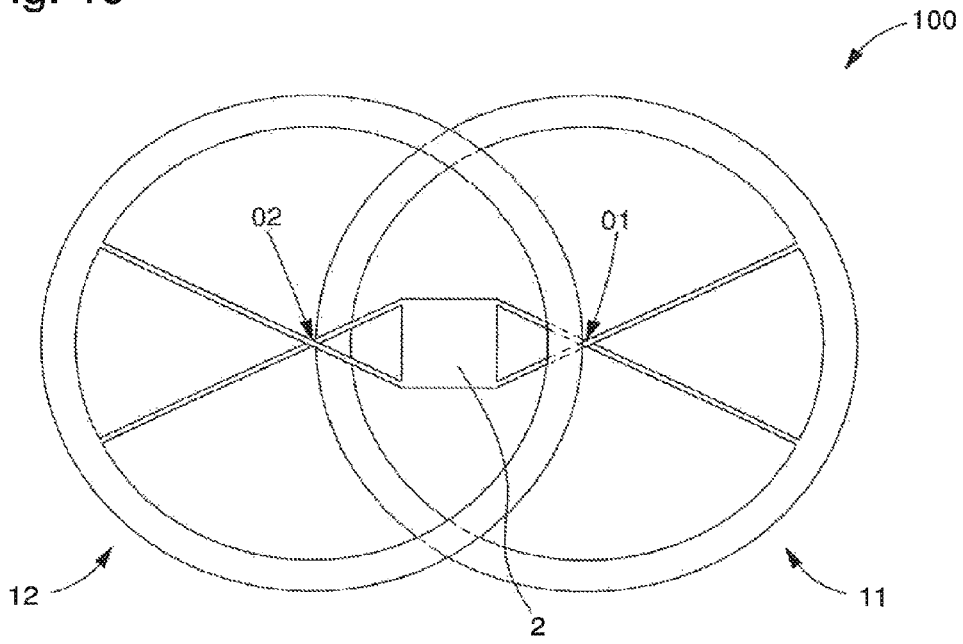
FIG. 19 illustrates an oscillator having two mobile parts, each formed by an annular balance connected by intersecting strips to the connection element, the two balances being located in separate parallel planes and pivoting about parallel virtual axes.
Figure 20:
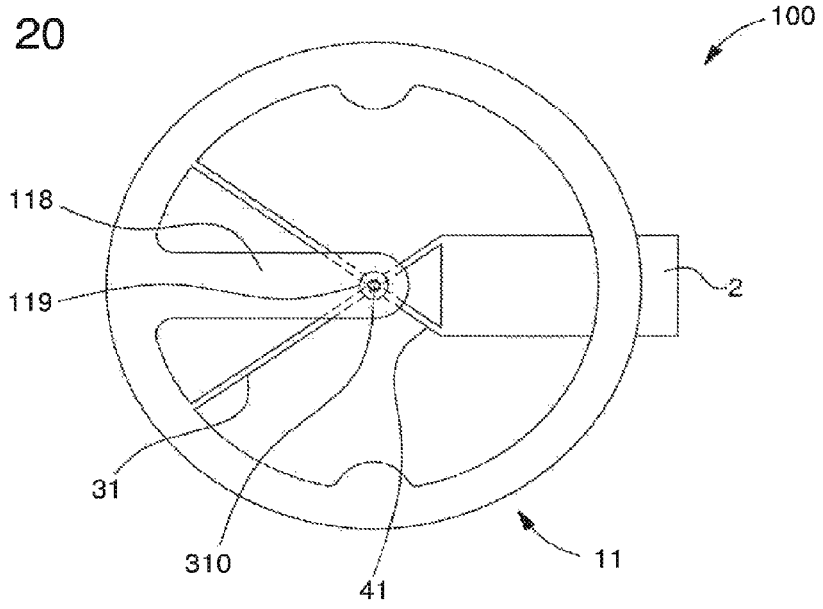
FIG. 20 shows a partial view of a mobile part comprising an arm provided with a hole which acts as a banking member for a pin integral with an upper strip.

In another advantageous embodiment, as seen in FIGS. 19 and 20, mobile part 11, 12, is made in the form of an annular balance.

Preferably, the resilient strips forming flexible elements 31, 41, 32, 42 are in symmetrical pairs in projection with respect to an axis passing through the virtual pivot axis concerned O1, O2, and through a main centre O on connection element 2.

In a preferred embodiment, when resonator 100 includes two mobile parts 11 and 12, the virtual pivot axes O1, O2 and main centre O are aligned.

In an advantageous embodiment, as seen in all the Figures, at least one such resonator 100 is a one-piece assembly comprising connection element 2, at least two mobile oscillating parts 11, 12 and resilient strips 31, 41, 32, 42 which connect the mobile part to connection element 2.

More specifically, at least one such resonator 100 is a one-piece assembly comprising connection element 2, and a plurality of mobile oscillating parts 11, 12, each comprising resilient strips 31, 41, 32, 42, which connect the mobile part to connection element 2.

Even more specifically, oscillator 200 is a one-piece assembly comprising connection element 2 and a plurality of such resonators 100.

In particular, oscillator 200 is a one-piece assembly further comprising a support 5 arranged to be fixedly secured to the structure of a timepiece movement 300, and a resilient connection 60 connecting support 5 to connection element 2.

Preferably, such a one-piece assembly is made of silicon and/or a silicon oxide, or DLC, or quartz, or any micro-material made in "MEMS" or "LIGA" technologies.

The use of such technologies makes it easier to provide adjustment means, for example notched areas on two opposing surfaces of the same one-piece component, to modify their relative position, and thereby the position of the centre of mass of a mobile part. In order to make an adjustment it is also possible to use usual means for making an adjustment to a timepiece balance, such as additional weights to increase inertia and lower frequency, and/or additional adjustment weights (adjustment screw, off-centre inertia blocks) to finely adjust the frequency or position of the centre of mass, or similar means.

To obtain a lower frequency of the oscillator, it is possible to add inertia, particularly by metal weights, pivoting on the inertia blocks or the arcs, or similar, of the mobile parts, or guided in translation with respect to these elements. For example, and in a non-limiting manner, a metal weight extending in direction Y may be guided, or even simply fixed, to two inertia blocks of the mobile part that are symmetrical with respect to axis X.

Creating such a tuning fork in a silicon part or similar, allows for high precision, and excellent relative adjustment of the centre of mass of each mobile part with the virtual pivot axis concerned. Each mobile part 11, 12 is therefore guided by means of intersecting strips, which are manufactured using double side silicon wafer technology. The space separating the intersecting strips may also have a very low value, which ensures maximum compactness. For example, the removal of an oxide layer formed between two layers is equivalent to 4 micrometres of play, which is sufficient to ensure proper operation with no friction between the strips.

This technology permits the manufacture of very thin strips, which can lower the oscillation frequency to a very low value, of around 40 Hz. In a specific embodiment, the resilient strips forming said flexible elements 31, 41, 32, 42, include an oxidation layer providing heat compensation.

Figure 15:
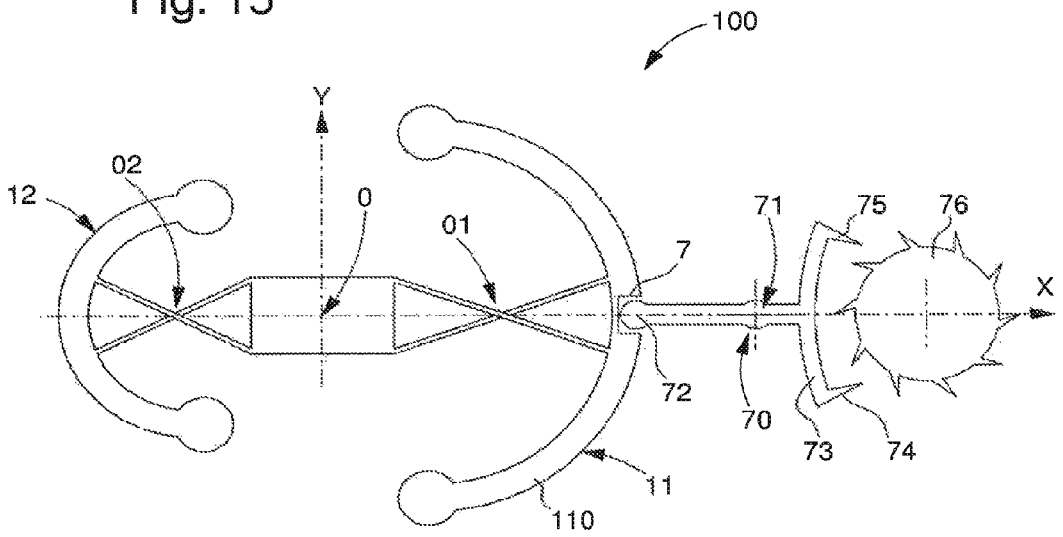
FIG. 15 illustrates the cooperation of an oscillator having two mobile parts of the FIG. 1 type with a lever escapement mechanism; an arc of one of the mobile parts includes a groove in which one end of the pallet-lever opposite the pallet-stones has limited mobility, the pallet-stones cooperating in a conventional manner with an escape wheel.

The lever effect of mobile parts 11, 12, can produce a sufficiently large movement of the end inertia blocks 111, 112, 121, 122 to allow such an oscillator 200 or at least such an oscillator 100, to be associated with a mechanical escapement mechanism, as seen in FIG. 15, or a magnetic, or electrostatic or similar escapement mechanism.

In a preferred, entirely symmetrical construction, the symmetrical motion of the inertia blocks, and of the centres of mass of the two mobile parts 11, 12, at the same point, or at least in immediate proximity to the same point, as the intersection of the strips, limits to a maximum the motion of the overall centre of mass of the complete system, and thus reactions on the support.

In a particular embodiment, oscillator 200 includes stop surfaces 80, 91, 92, limiting the motion of each mobile part 11, 12, comprised in said oscillator 200. This ensures resistance against the greatest shocks.

The invention also concerns a timepiece movement 300 comprising a structure to which is fixed an oscillator 200, either directly by its connection element 2, or by means of a support 5 to which the connection element 2 is connected by a resilient connection 60.

The invention also concerns a timepiece 400, particularly a watch, including at least one such timepiece movement 300.

The Figures detail certain specific, non-limiting embodiments.

Figure 2:
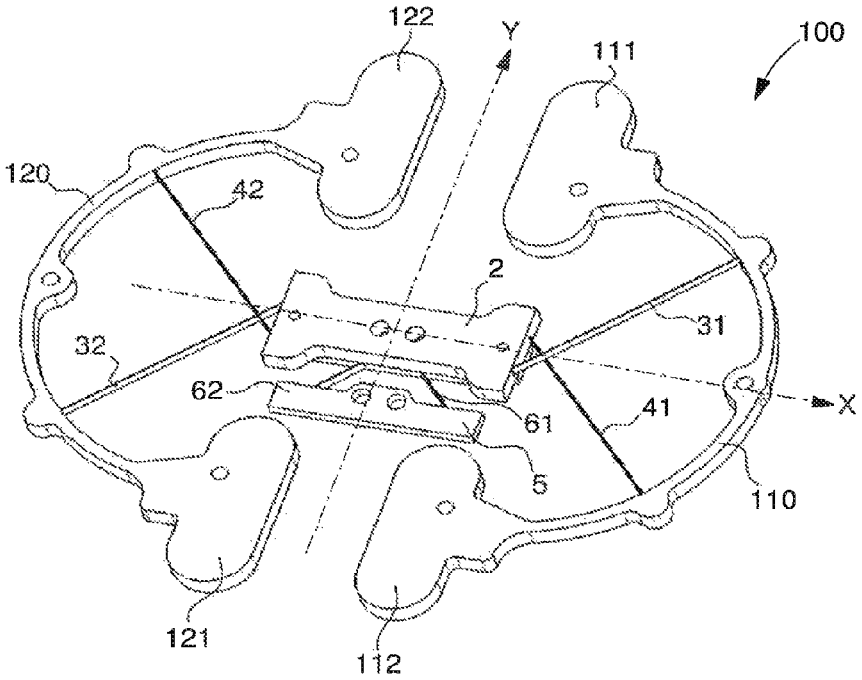
FIG. 2 shows a schematic, perspective view of the oscillator of FIG. 1.
Figure 3:
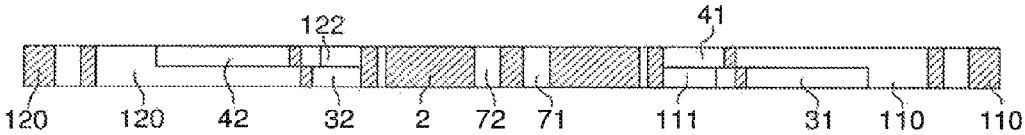
FIG. 3 shows a schematic, partial, sectional view of the same oscillator through plane AA of FIG. 1.

FIGS. 1 to 3 show an oscillator with a tuning fork resonator 100, comprising two mobile parts 11 and 12 arranged symmetrically with respect to a connection element 2, to which each mobile part is connected by a resilient connection, more particularly formed by flexible elements 31, 41, 32, 43 and around which each mobile part oscillates about a virtual axis Connection element 2 is in turn connected by another resilient connection to a support 5 integral with the structure of a timepiece movement 300. In this embodiment, flexible elements 31, 41, 32, 43, are resilient strips located on separate levels in pairs, and whose directions, in a neutral rest position of the resonator, intersect at the virtual axis O1, O2 concerned. The two virtual axes are aligned with a main centre O on connection element 2. The construction is entirely symmetrical with respect to a plane of abscissa containing a direction X with virtual axes O1, O2 and main centre O, and to an ordinate plane, containing a direction Y, orthogonal to the preceding plane and intersecting it at main centre O.

Figure 4:
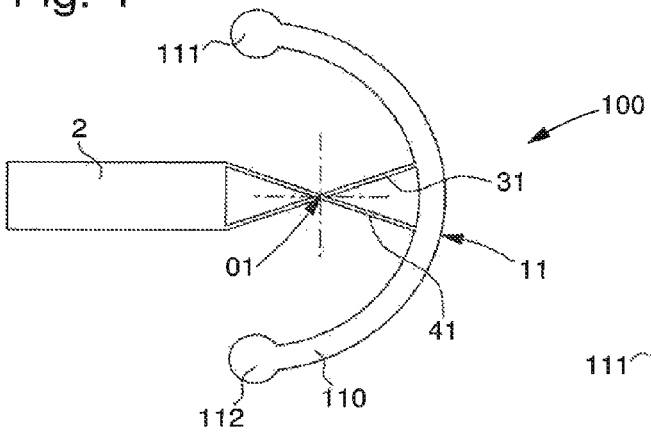
FIG. 4 shows a schematic, partial plan view of a mobile part of a resonator connected by means of flexible elements to the connection element.
Figure 6:
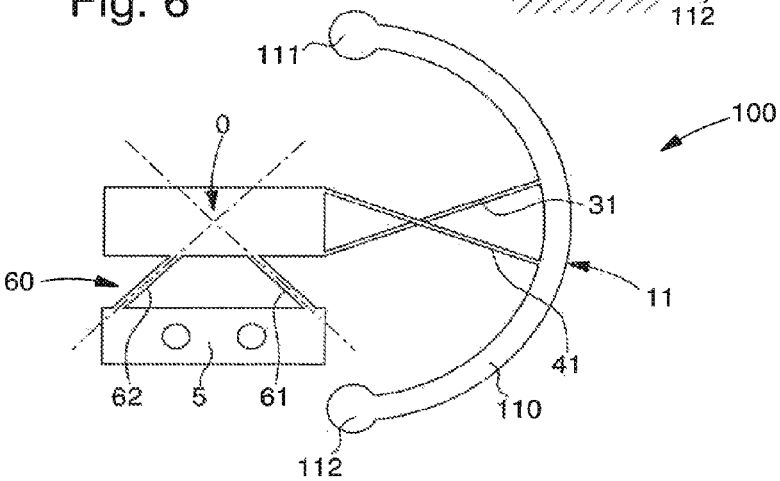
FIG. 6 shows a partial view of the resonator of FIG. 4, wherein the connection element is connected to a fixed support integral with the structure by a resilient connection with resilient strips whose directions converge towards a main centre, as in the embodiment of FIGS. 1 and 2.

FIG. 4 shows a mobile part 11 of a resonator 100, with the same type of connection by means of flexible elements 31, 41, to connection element 2. FIG. 5 shows the resonator 100 of FIG. 4, wherein connection element 2 is connected to a fixed support 5 integral with the structure by a single connection 60. FIG. 6 shows resonator 100 of FIG. 4, wherein connection element 2 is connected to a fixed support 5 integral with a structure by a resilient connection with two resilient strips 61 and 62, whose directions converge towards main centre O, as in the embodiment of FIGS. 1 to 3.

Figure 7:
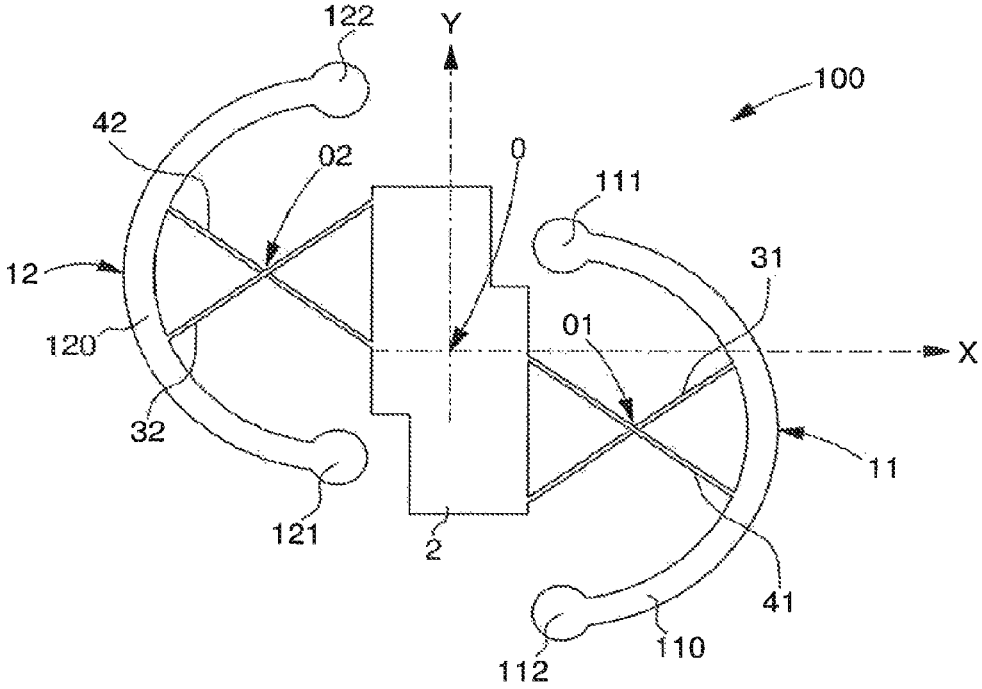
FIG. 7 shows a variant of the oscillator of FIG. 1, in which the two mobile parts are offset relative to the ordinate direction.

FIG. 7 shows a variant of the oscillator of FIG. 1, wherein the two mobile parts 11 and 12 are offset with respect to the ordinate direction Y, and each oscillates about an axis X1, respectively X2, parallel to each other. It is essential that these directions are parallel to ensure a very low timing error.

Figure 8:
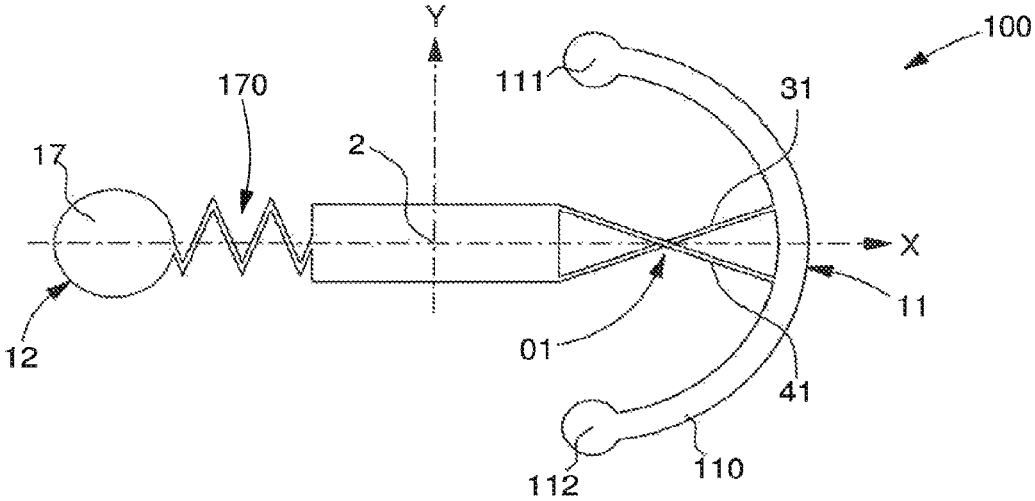
FIG. 8 shows another variant wherein one of the mobile parts is in the form of an arc provided with end inertia blocks like the mobile parts of FIGS. 1 to 7, while the other mobile part is a weight suspended by a single resilient connection, such as a spring.

FIG. 8 shows another variant wherein one of the mobile parts 11 is in the form of an arc 110 provided with end inertia blocks 111, and 112, like mobile parts 11 and 12 of FIGS. 1 to 7, whereas the other mobile part 12 is a weight 17 suspended by a single resilient connection 170 such as a spring or a single strip, or similar.

Other variants are also possible, for example with a mobile part suspended by an RCC Remote Center Compliance type connection with four necks or similar.

Figure 9:
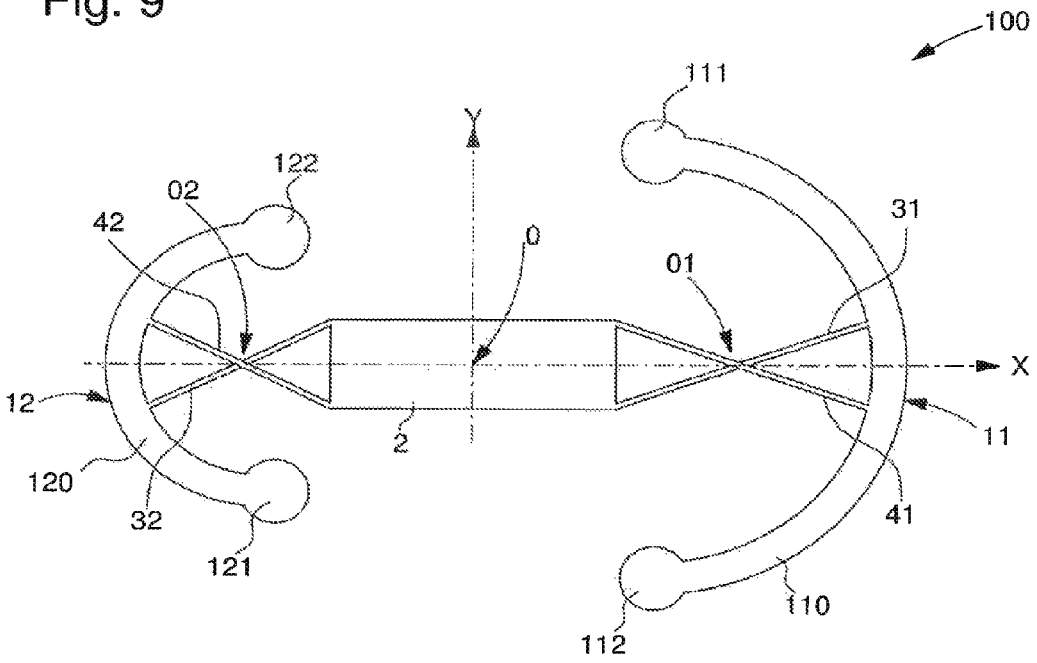
FIG. 9 shows a variant of the oscillator of FIG. 1, wherein the two mobile parts are of the arc type with end inertia blocks, but of different dimensions, and with a different stiffness of the flexible elements.

FIG. 9 shows a variant of the oscillator of FIG. 1, in which the two mobile parts 11 and 12 are of the type with an arc 110, 120 with end inertia blocks 111, 112, 121, 122, but of different dimensions, and a different stiffness of flexible elements 31, 41 on the one hand, and 32, 42 on the other hand, so as to obtain the same frequency. The symmetry of movement of the centres of mass can thus be maintained, but with a different amplitude on either side.

Figure 10:
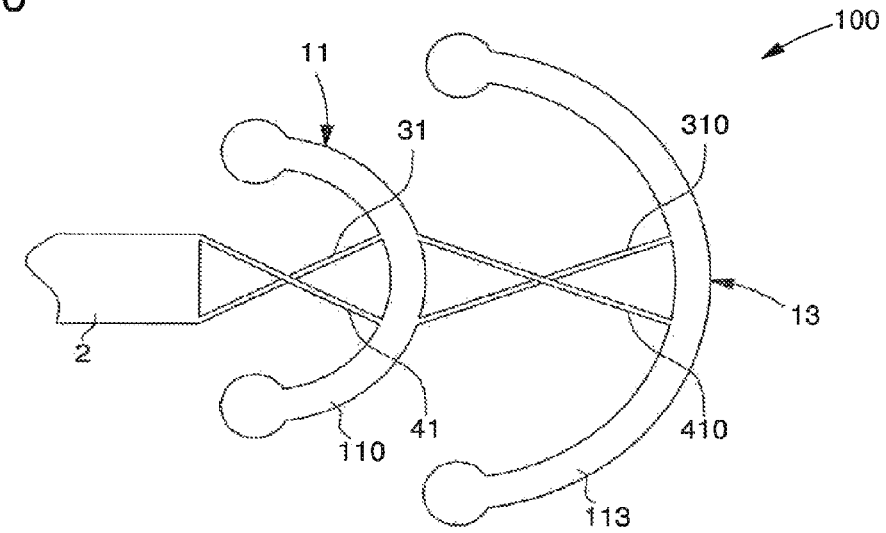
FIG. 10 shows a partial view of a variant of the resonator of FIG. 4, wherein a second mobile part is suspended in series on the first.

FIG. 10 shows a variant of the resonator of FIG. 4, in which a second mobile part 13 in an arc 113 is suspended in series on first mobile part 11, by means of similar intersecting strips 310, 410, abutting on the first arc 110 of the first mobile part 11.

Figure 11:
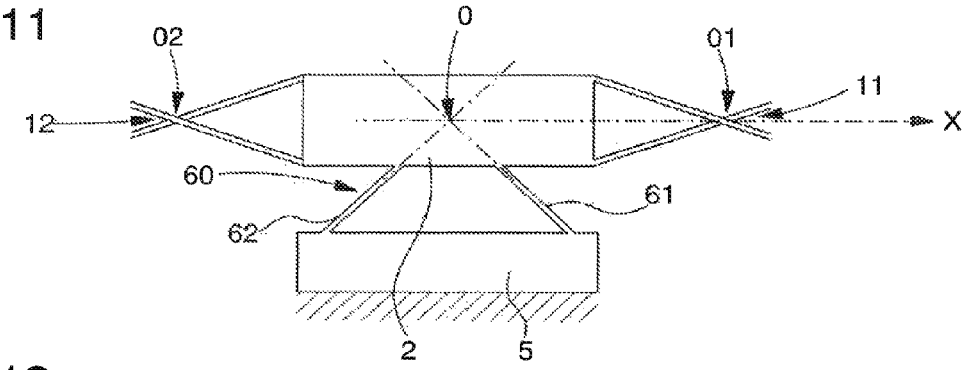
FIGS. 11 to 14 illustrate partial views of different types of connection between the connection element and the support fixed to the structure: with strips converging towards the main centre in FIGS. 11 and 12, with a single resilient connection such as a spring or a single strip in FIGS. 13 and 14, the support being external to the connection element in FIGS. 11 and 13, and internal to the connection element in FIGS. 12 and 14.
Figure 12:
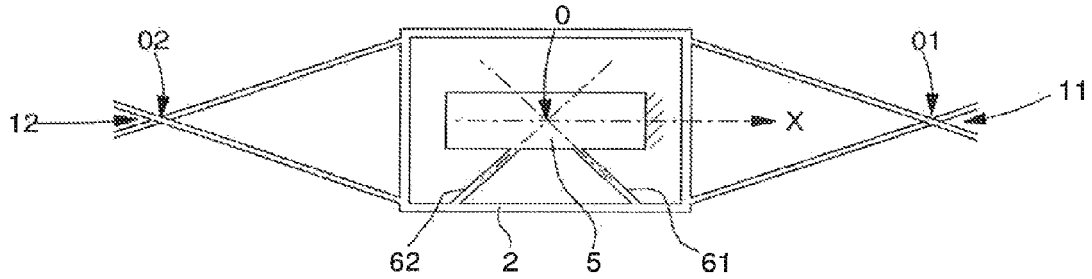

FIGS. 11 to 14 illustrate different types of connection between connection element 2 and support 5 fixed to the structure of movement 300: with strips 61 and 62 converging towards main centre O in FIGS. 11 and 12, with a single resilient connection 60, such as a spring or a single strip in FIGS. 13 and 14, support 5 being external to connection element 2 in FIGS. 11 and 13, and internal to connection element 2 in FIGS. 12 and 14.

This resilient connection between connection element 2 and support 5 ensures good shock absorption FIG. 15 illustrates the cooperation of an oscillator with two mobile parts 11, 12, of the FIG. 1 type with a lever escapement mechanism 70; an arc 110 of a first mobile part 11 includes a groove 7 in which one end 72 of a pallet lever 70 has limited mobility, pivoting along an axis 71, opposite to pallet-stones 74, 75 of a fork 73, which cooperate in a conventional manner with an escape wheel 76.

Figure 16:
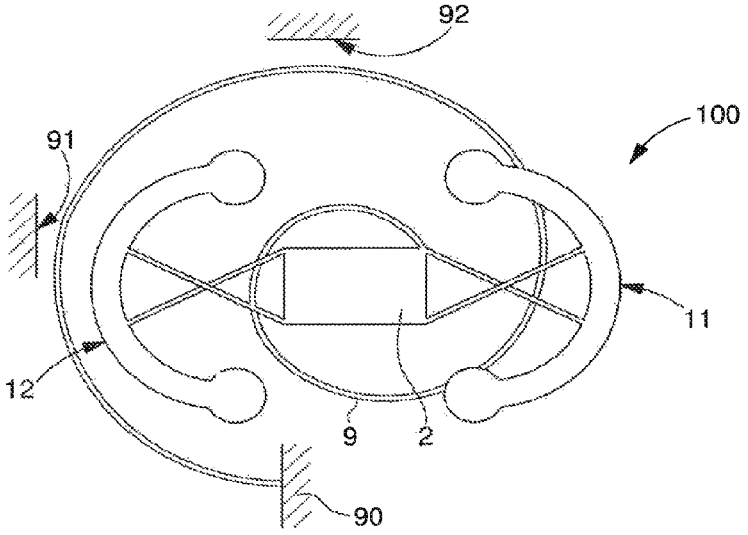
FIG. 16 shows an oscillator having two mobile parts of the FIG. 1 type and wherein the connection element is connected to the structure by a balance spring, the structure comprising banking surfaces.

FIG. 16 illustrates an oscillator with two mobile parts 11, 12, of the FIG. 1 type and wherein connection element 2 is connected to structure 90 by a balance spring 9, structure 90 comprising banking surfaces 91, 92, which may be arranged to limit the motion of said spring 9, and/or to limit the motion of mobile parts 11, 12.

Figure 17:
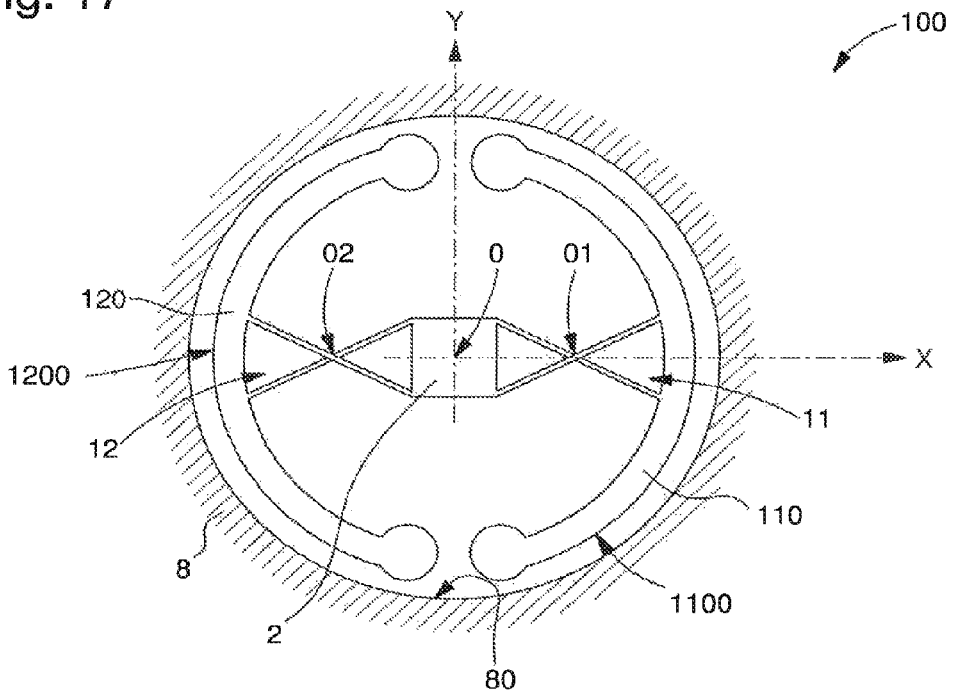
FIG. 17 shows an oscillator having two mobile parts of the FIG. 1 type, whose contour at rest is substantially circular, and which moves in a circular housing of the structure forming a banking member.
Figure 18:
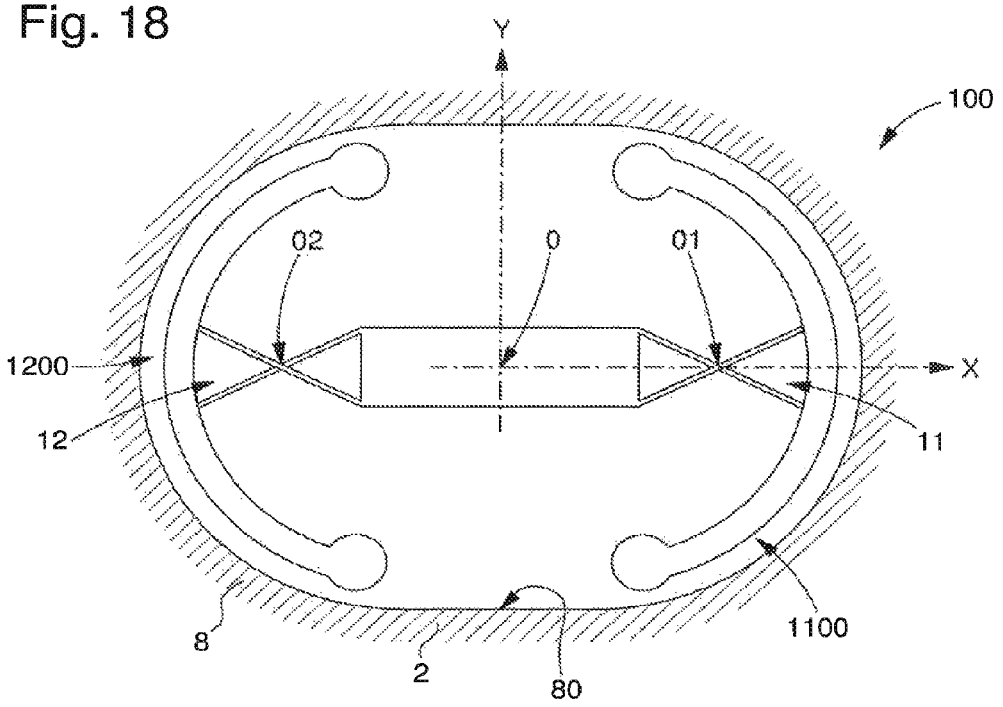
FIG. 18 illustrates an oblong version according to the same principle

FIG. 17 illustrates an oscillator with two mobile parts 11, 12 of the FIG. 1 type, whose contour 1100, 1200 at rest is substantially circular, and which moves in a circular housing 80 of structure 8 acting as a banking member, and FIG. 18 illustrates an oblong version according to the same principle. The distance between the rest position of mobile parts 11, 12 and housing 80 is reduced to the bare minimum compatible with the range of oscillation of the inertia blocks, on the order of several tens of a millimetre.

FIG. 19 illustrates an oscillator with two mobile parts 11, 12 each formed by an annular balance connected by intersecting strips to connection element 2, the two balances being located in separate parallel planes, and pivoting about parallel virtual pivot axes O1 and O2.

FIG. 20 illustrates an oscillator with a mobile part 11 that has an arm 118 provided with a hole 119 which acts as a banking member for a pin 310 integral with an upper strip 31.

Figure 21:
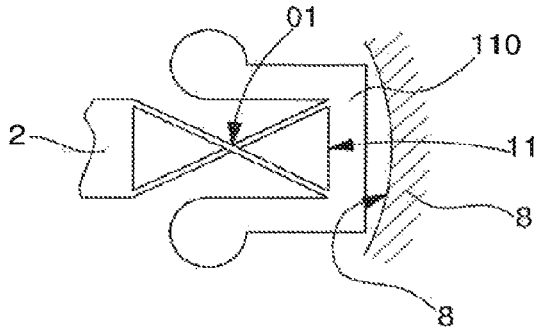
FIG. 21 shows a partial view of an oscillator in a structure having one wall which limits the travel of the end points of a mobile part.
Figure 22:
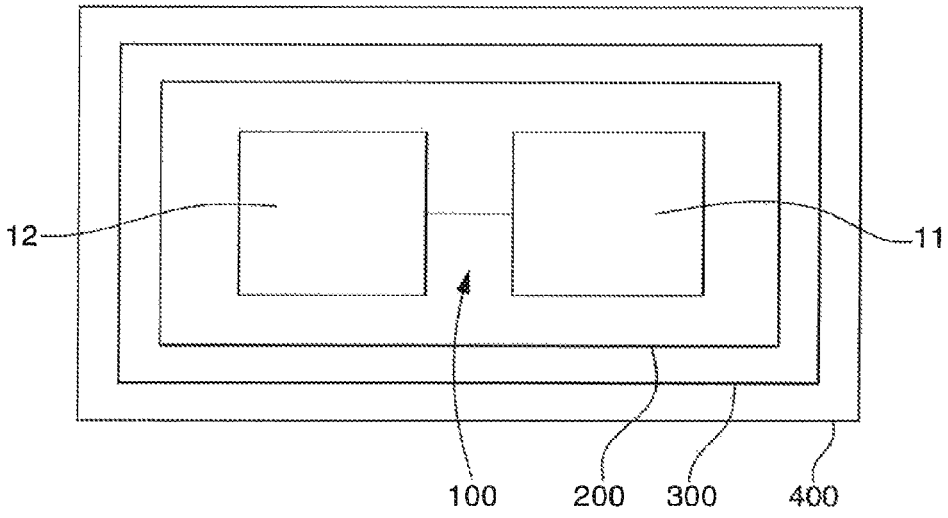
FIG. 22 is a block diagram showing a timepiece including a movement with a mechanism comprising one such oscillator.

FIG. 21 illustrates an oscillator in a structure 8 having a wall 80 that limits the travel of the end points of a mobile part 11 of any shape.

The Figures are very schematic and illustrate a general case where the intersecting strips are embedded obliquely in the connection element that carries them. An advantageous configuration consists in embedding the strips in a surface that is orthogonal to the end of each strip where it is embedded in the connection element.

The invention makes it possible to obtain a one-piece mechanism that is easy to install, reliable, very reproducible, with a high quality factor, low energy consumption, and ensuring a high level of autonomy of the movement.

What is claimed is:

1. An oscillator for a timepiece, comprising a time base with at least one resonator formed by a tuning fork, which includes at least two mobile oscillating parts, said mobile parts being secured to a connection element, comprised in said oscillator, by flexible elements whose geometry determines a virtual pivot axis having a determined position relative to said connection element, said respective mobile part oscillates about said virtual pivot axis, the centre of mass of the mobile part coincides in the rest position with said respective virtual pivot axis, wherein, for at least one said mobile part, said flexible elements are formed of intersecting resilient strips extending at a distance from each other in two parallel planes, and whose directions, in projection on one of said parallel planes, intersect at said virtual pivot axis of said mobile part.

2. The oscillator according to claim 1, wherein said at least one resonator comprises two said mobile parts whose centres of mass correspond to virtual pivot axes aligned with a main centre of said connection element.

3. The oscillator according to claim 2, wherein said two mobile parts are symmetrical with respect to an axis of symmetry passing through a main centre of said connection element.

4. The oscillator according to claim 2, wherein said connection element couples the motions of said two mobile parts by elastic forces.

5. The oscillator according to claim 2, wherein said connection element couples said two mobile parts to ensure a symmetrical motion thereof with respect to said main centre.

6. The oscillator according to claim 1, wherein said connection element is suspended by at least one resilient connection from a support arranged to be fixed on a structure of a timepiece movement.

7. The oscillator according to claim 6, wherein said resilient connection is achieved by resilient strips whose directions converge towards said main centre of said connection element.

8. The oscillator according to claim 7, wherein said resilient strips forming said flexible elements are less stiff than said arc and said inertia blocks.

9. The oscillator according to claim 1, wherein at least one said mobile part includes a substantially circular arc around said respective virtual pivot axis, said arc comprising an inertia block at each end thereof, and wherein said flexible elements cooperate with said arc.

10. The oscillator according to claim 1, wherein said resilient strips forming said flexible elements are in symmetrical pairs in projection with respect to an axis passing through said virtual pivot axis, and through a main centre on said connection element.

11. The oscillator according to claim 10, wherein said at least one resonator is a one-piece assembly comprising said connection element, and a plurality of said mobile oscillating parts each including said resilient strips which connect said mobile part to said connection element.

12. The oscillator according to claim 10, wherein said oscillator is a one-piece assembly further comprising a support arranged to be fixedly secured to the structure of a timepiece movement, and a resilient connection connecting said support to said connection element, and wherein said resilient strips forming said flexible elements include an oxidation layer providing heat compensation.

13. The oscillator according to claim 1, wherein said at least one resonator is a one-piece assembly comprising said connection element, at least one said mobile oscillating part and said resilient strips which connect said mobile part to said connection element.

14. The oscillator according to claim 13, wherein said one-piece assembly is made of silicon and/or a silicon oxide, or diamond-like-carbon, or quartz.

15. The oscillator according to claim 1, wherein said oscillator is a one-piece assembly comprising said connection element and a plurality of said resonators.

16. The oscillator according to claim 1, wherein said oscillator comprises stop surfaces limiting the motion of each said mobile part.

17. A timepiece movement comprising a structure to which is fixed said oscillator according to claim 1, either directly by said connection element thereof, or by means of a support to which said connection element is connected by a resilient connection.

18. A timepiece or watch including at least one timepiece movement according to claim 17.

* * * * *